US011433563B2

(12) United States Patent
Seferi

(10) Patent No.: US 11,433,563 B2
(45) Date of Patent: Sep. 6, 2022

(54) SAFETY KNIFE WITH SLIDABLE GRIP

(71) Applicant: Acme United Corporation, Fairfield, CT (US)

(72) Inventor: Nicholas L. Seferi, Southbury, CT (US)

(73) Assignee: Acme United Corporation, Fairfield, CT (US)

( * ) Notice: Subject to any disclaimer, the term of this patent is extended or adjusted under 35 U.S.C. 154(b) by 89 days.

(21) Appl. No.: 16/999,653

(22) Filed: Aug. 21, 2020

(65) Prior Publication Data

US 2021/0053242 A1 Feb. 25, 2021

Related U.S. Application Data

(60) Provisional application No. 62/890,651, filed on Aug. 23, 2019.

(51) Int. Cl.

| | |
|---|---|
| ***B26B 29/02*** | (2006.01) |
| ***B26B 5/00*** | (2006.01) |
| ***B25G 1/10*** | (2006.01) |

(52) U.S. Cl.

CPC ..... *B26B 29/02* (2013.01); *B25G 1/102* (2013.01); *B26B 5/003* (2013.01); *B26B 5/005* (2013.01)

(58) Field of Classification Search

USPC ..... 30/2

See application file for complete search history.

(56) References Cited

U.S. PATENT DOCUMENTS

| | | | | |
|---|---|---|---|---|
| 4,086,698 | A * | 5/1978 | Sparks | B26B 27/005 30/2 |
| 4,091,537 | A * | 5/1978 | Stevenson, Jr. | B26B 29/02 30/151 |
| 5,093,994 | A * | 3/1992 | Karas | B26B 5/001 30/125 |
| 5,890,290 | A * | 4/1999 | Davis | B26B 29/02 30/2 |
| 5,906,049 | A * | 5/1999 | Butts | B26B 5/001 30/125 |
| 6,233,832 | B1 * | 5/2001 | Berns | B26B 5/00 30/162 |
| 6,892,456 | B2 * | 5/2005 | Yu Chen | B26B 5/00 30/125 |
| 8,375,588 | B2 * | 2/2013 | Gringer | B26B 5/001 30/2 |
| 10,994,430 | B2 * | 5/2021 | Wang | B26B 5/001 |
| 2009/0151168 | A1 * | 6/2009 | Dadam | B26B 29/02 30/146 |
| 2011/0167646 | A1 * | 7/2011 | Schmidt | B26B 3/06 30/151 |
| 2021/0053242 | A1 * | 2/2021 | Seferi | B26B 29/02 |
| 2021/0053243 | A1 * | 2/2021 | Seferi | B26B 5/003 |

FOREIGN PATENT DOCUMENTS

GB 2 192 358 A * 1/1988

* cited by examiner

*Primary Examiner* — Hwei-Siu C Payer
(74) *Attorney, Agent, or Firm* — Alix, Yale & Ristas, LLP

(57) ABSTRACT

A safety knife functions as both a box cutter and a separate line cutter. A slidable grip is manually displaceable between two stable safety positions. In one safety position, the grip obstructs access to a forwardly projecting blade. In a second safety position, the grip obstructs access to the line cutter.

18 Claims, 10 Drawing Sheets

SAFETY KNIFE WITH SLIDABLE GRIP

CROSS-REFERENCE TO RELATED APPLICATION

This application claims the priority of U.S. Provisional Application No. 62/890,651 filed on Aug. 23, 2019, the disclosure of which is incorporated by reference in its entirety.

BACKGROUND

This disclosure relates generally to utility knives which are commonly referred to as box cutters. More particularly, this disclosure relates to utility knives which have a dual cutting blade configuration.

For utility knives to which the present disclosure relates, an elongated housing employs a slide assembly which is manually displaceable for projecting a cutting blade through a frontal opening. The cutting blades are typically trapezoidal or quasi-trapezoidal in shape. The housing is formed by a pair of elongated sections which are relatively displaceable to allow for blade replacement or removal. In some conventional utility knives, multiple replacement blades are stored within the housing and are mountable for use to replace a degraded cutting blade.

SUMMARY

Briefly stated, a safety utility knife has a housing with a front having a frontal blade opening. The housing also has a rear opening protectively leading to a restricted blade opening. A grip is mounted to the housing for slidable displacement between a first position obstructing access to a blade projecting from the frontal blade opening and a second position obstructing access to a blade positioned at the restricted blade opening. A first mechanism selectively secures the grip in a stable engagement at either the first position or the second position. A second mechanism slidably projects a blade for extension through the frontal opening at multiple exposed positions.

The housing has a longitudinal slot. The grip is secured to a slide member disposed in the housing through the slot. The slide member has a pair of longitudinally spaced detents. A spring-loaded pin is receivable in one of the detents. The housing mounts a laterally displaceable button which is manually moveable to withdraw the pin from a detent and allow the slide member to slide relative to the housing.

A blade is fixedly mounted for access through the restricted blade opening. Another blade is mounted to a longitudinally positionable slide. The housing mounts a longitudinally displaceable button moveable to change the position of the slide.

The grip preferably has a plurality of transversely extending serrations. The grip preferably has a rubber molded composition. The grip has a quasi-U-shaped section which extends at opposed sides of the housing. The front of the knife has a nose-like configuration.

DETAILED DESCRIPTION

Figure 1:
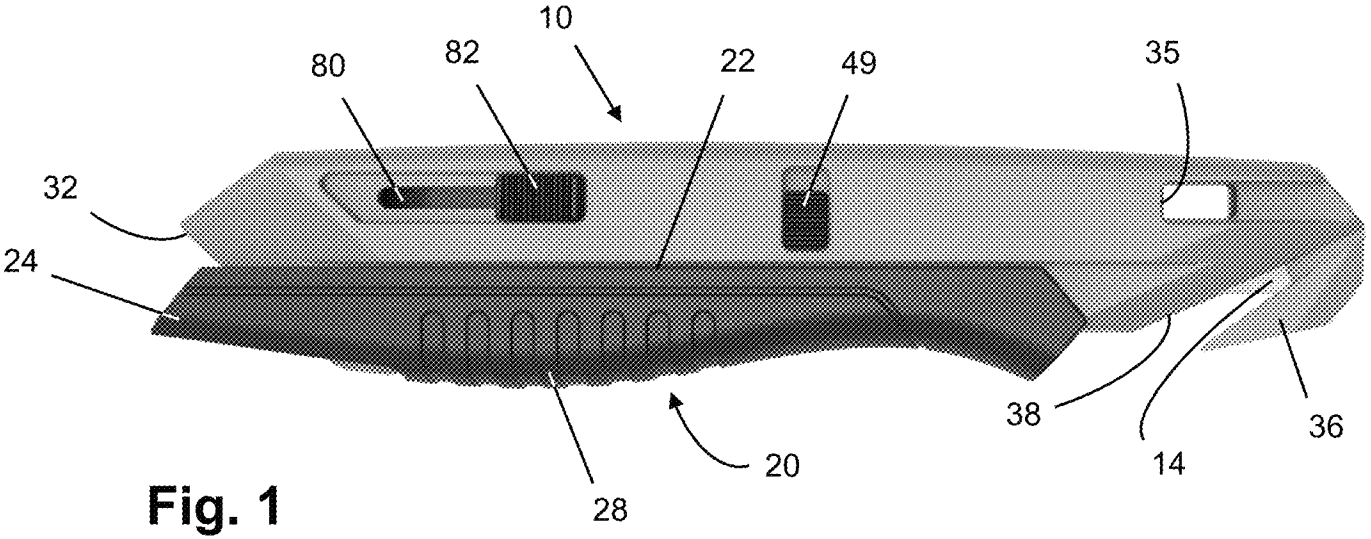
FIG. 1 is a front side view, partly diagrammatic, of a safety knife with a grip disposed in a first position.
Figure 2:
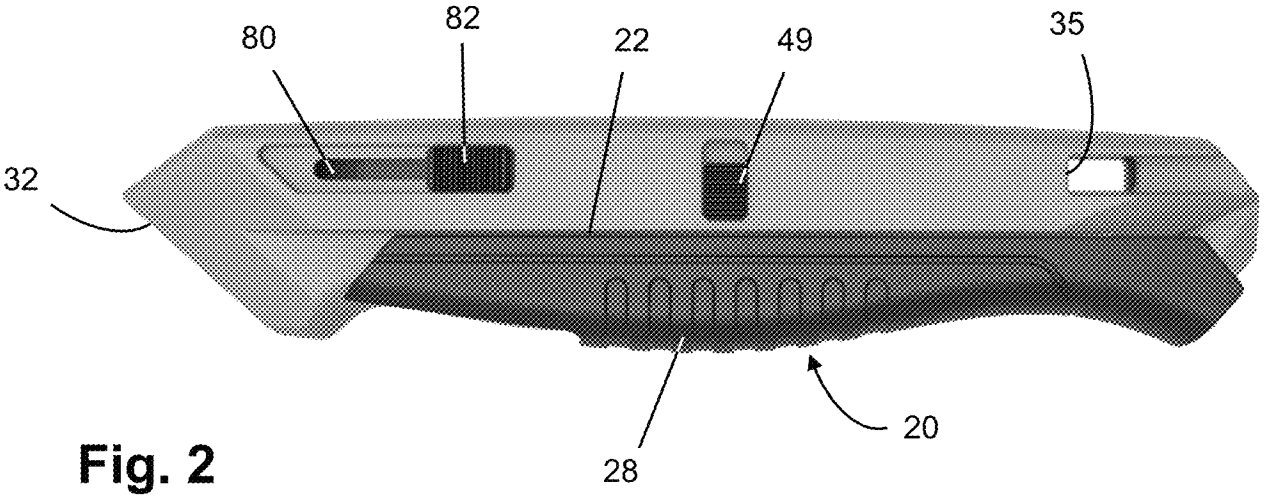
FIG. 2 is a front side view of the knife of FIG. 1 with the grip being disposed in a second position.
Figure 3:
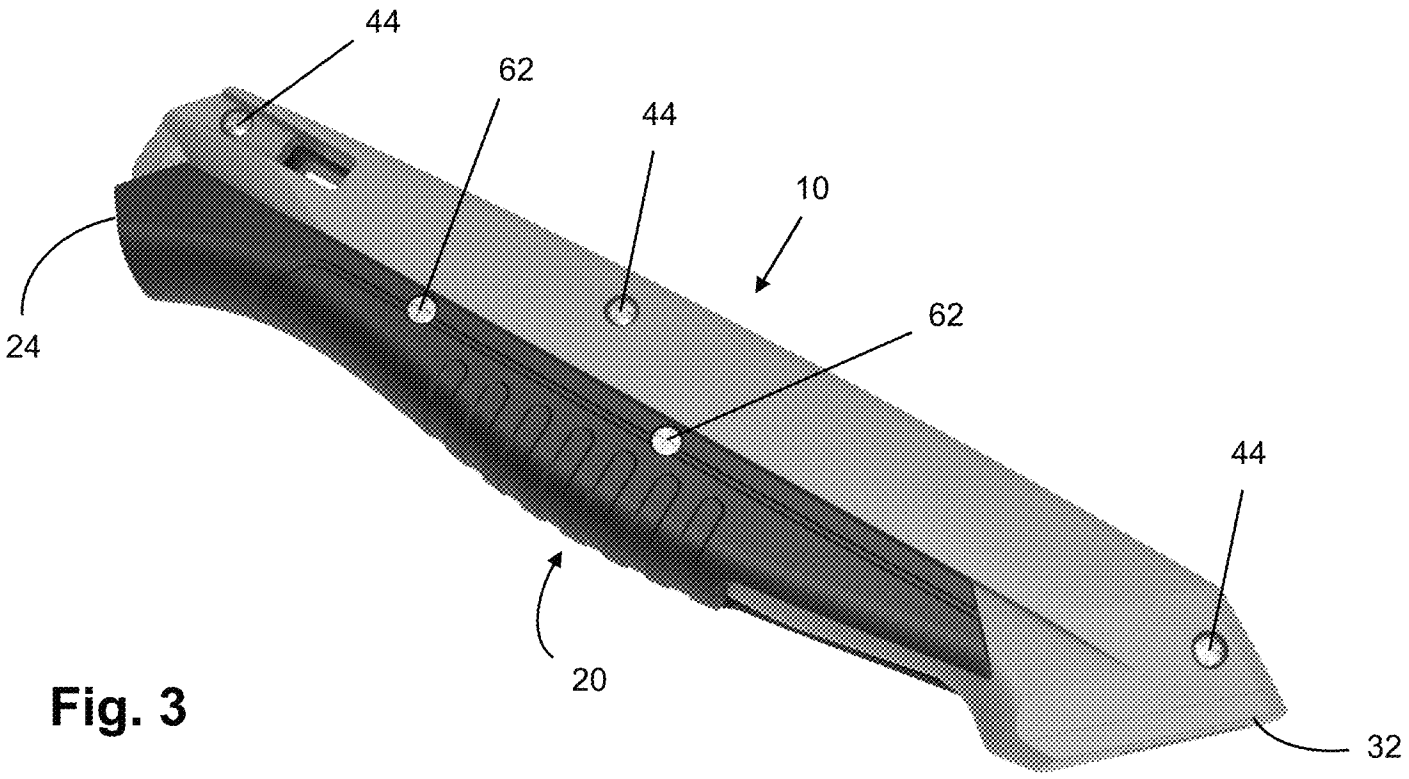
FIG. 3 is a generally back perspective view of the knife at the grip position of FIG. 2.

With reference to the drawings wherein like numerals represent like parts throughout the several figures, a safety utility knife in accordance with the present disclosure is generally designated by the numeral 10. The safety knife functions as both a box cutter and a separate line cutter. The safety knife incorporates a slidable grip 20 which is manually longitudinally displaceable and maintainable in two stable safety positions. In a first stable safety position illustrated in FIG. 1, the grip 20 is positioned at a forward position to obstruct access to a forward projecting blade 12. In a second stable safety position best illustrated in FIG. 2, the safety slide is disposed in a second rearward position restricting access to the line cutter blade 14.

The safety knife has an elongated contoured aesthetically pleasing housing 30. The safety grip 20 likewise has a coordinated contoured structure which has a soft and convenient feel for the user as will be detailed below.

The knife has a housing 30 which is formed from a pair of elongated shell-like sections 40 and 50. The sections engage along a medial centerline through the top and bottom. The forward portion of the housing forms a nose-like protuberance 32. The protuberance defines a frontal blade opening 34. A rear portion of the housing forms a sleek rear shield 36 to obstruct access to a restricted blade opening 38. In one preferred embodiment, the housing also has a rectangular through opening 35 which allows the knife to be tethered to a chain or hung on a hook or appendage as desired.

Figure 5:
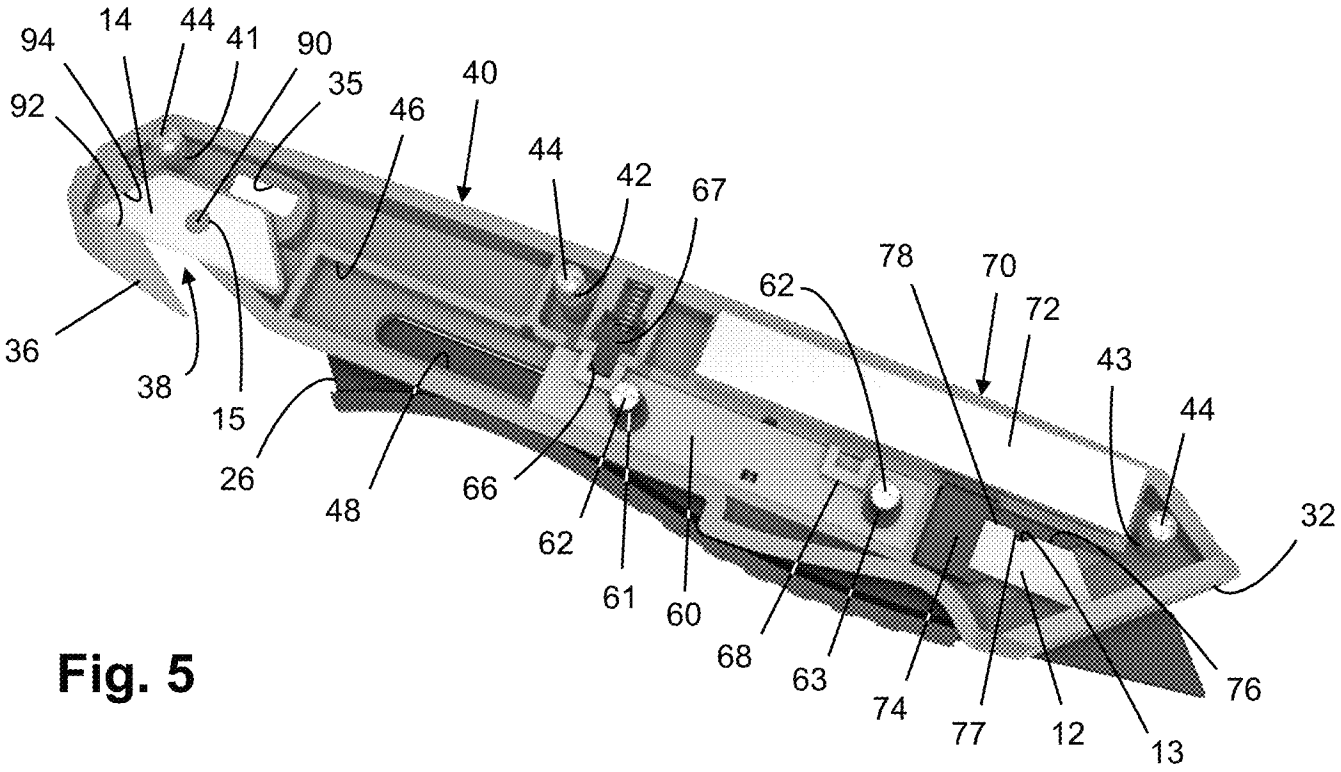
FIG. 5 is a perspective view with a portion of the blade being removed and further illustrating the grip of FIG. 1.
Figure 6:
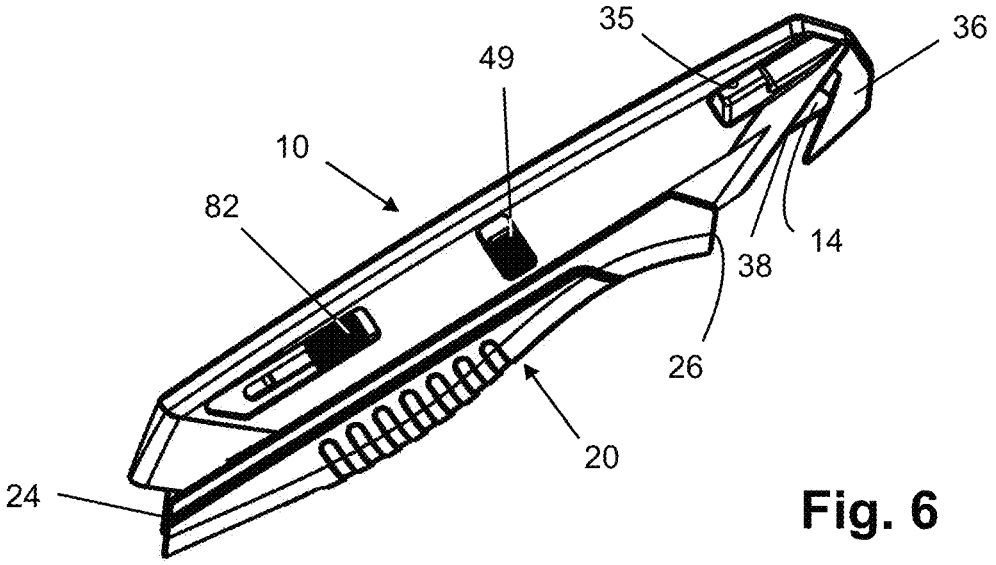
FIG. 6 is a generally frontal perspective view of the knife with the grip position of FIG. 1.
Figure 11:
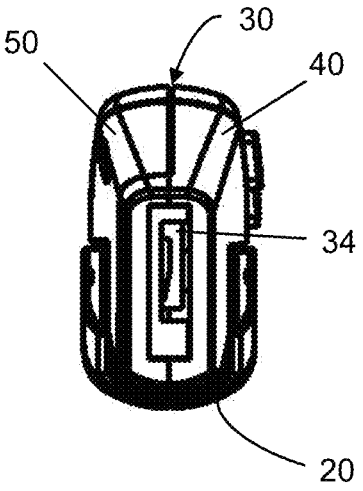
FIG. 11 is a left side view of the knife with the grip position of FIG. 1.
Figure 12:
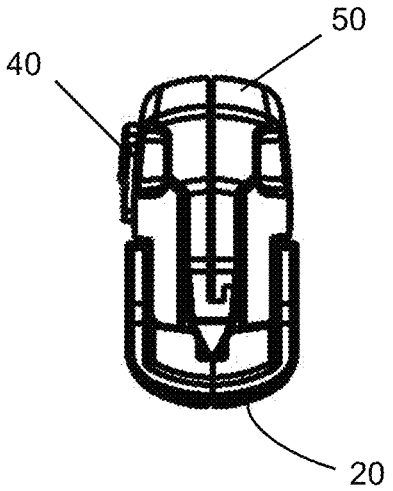
FIG. 12 is a right side view of the knife with the grip position of FIG. 1.
Figure 7:
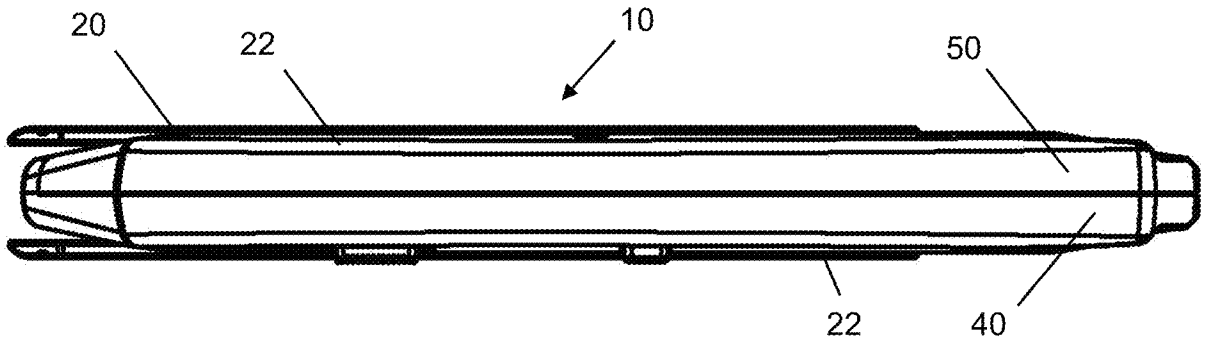
FIG. 7 is a top plan view of the knife with the grip position of FIG. 1.
Figure 8:
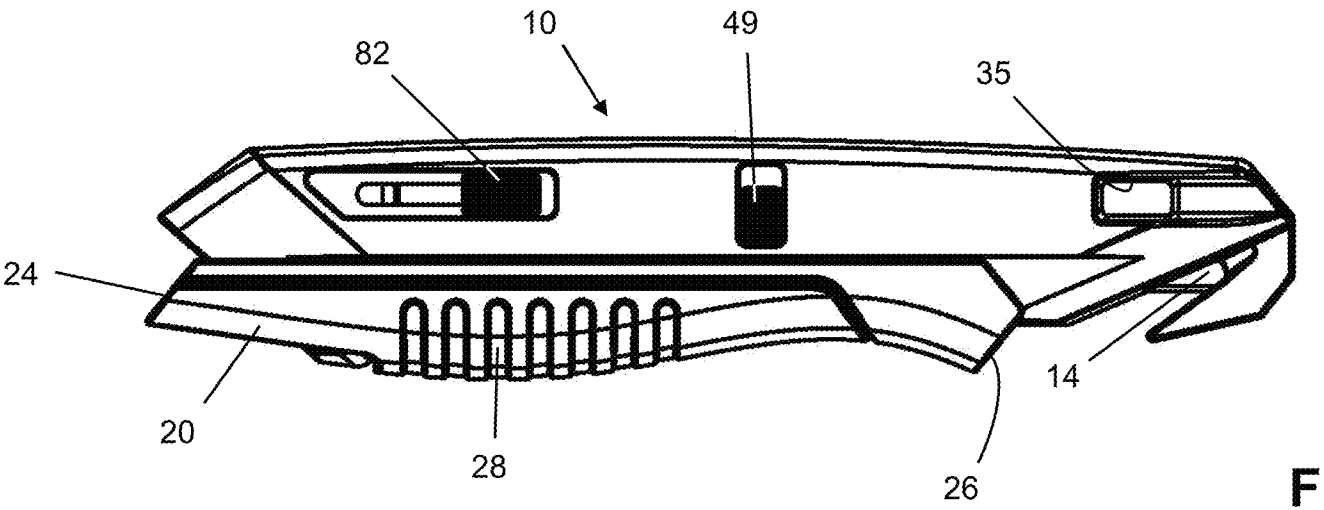
FIG. 8 is a front view of the knife with the grip position of FIG. 1.
Figure 9:
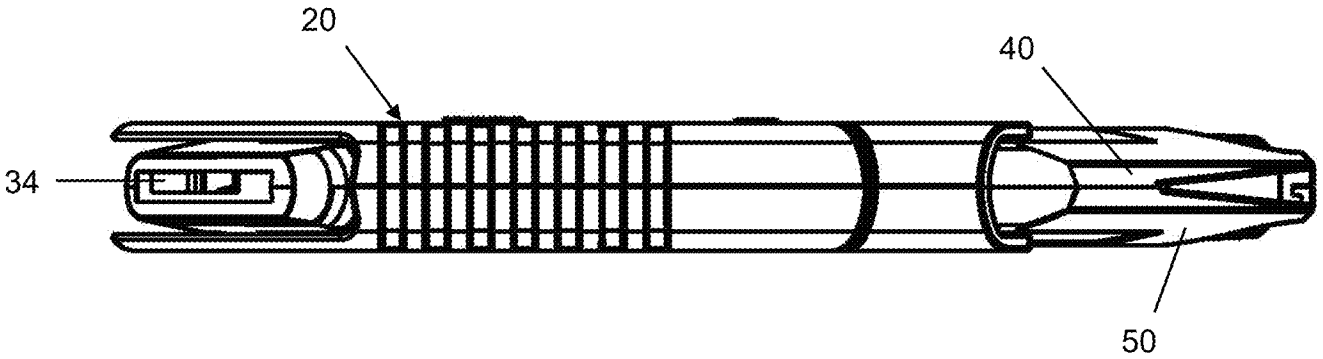
FIG. 9 is a bottom plan view of the knife with the grip position of FIG. 1.
Figure 10:
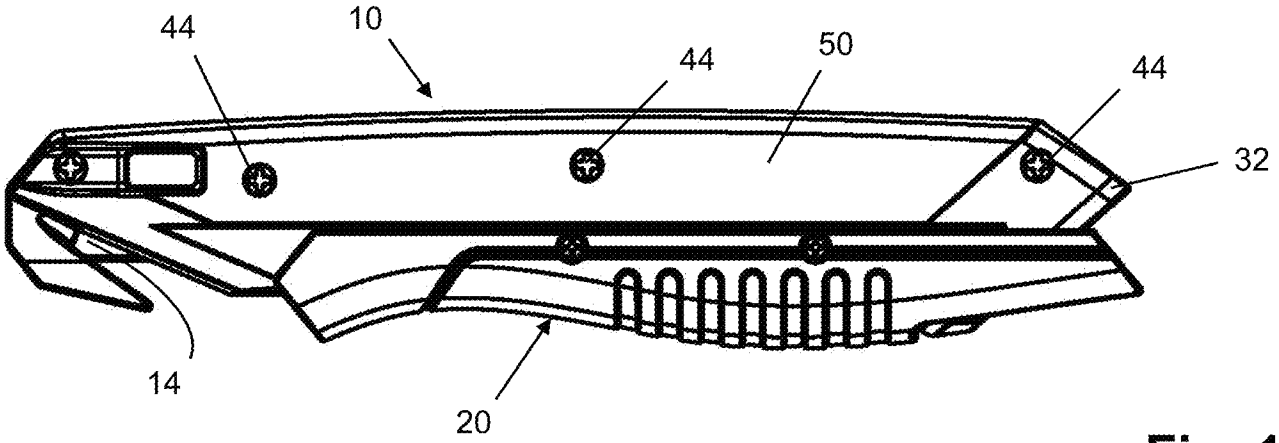
FIG. 10 is a back view of the knife with the grip position of FIG. 1.
Figure 13:
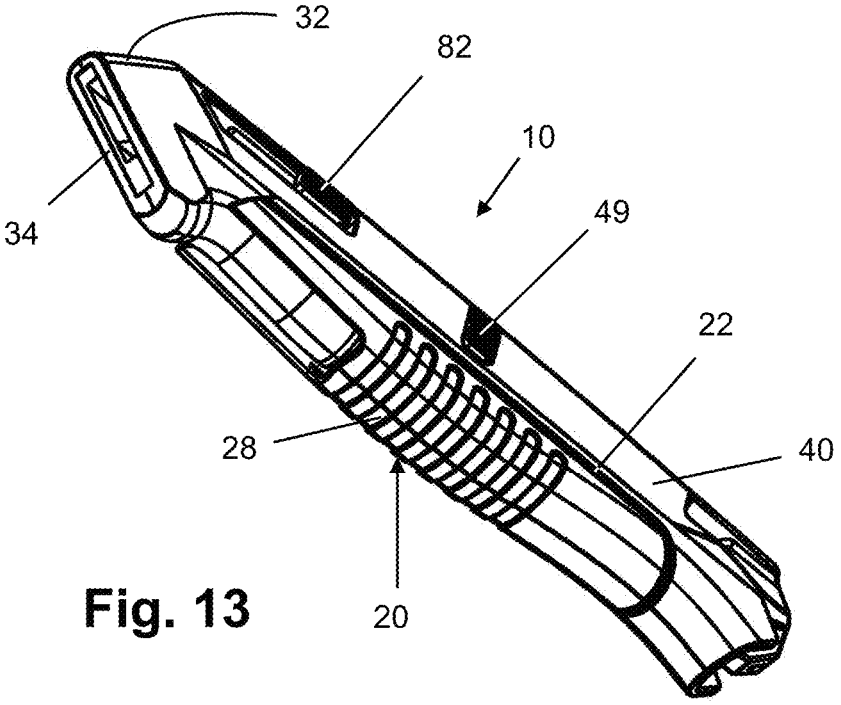
FIG. 13 is a perspective view of the knife with the grip position of FIG. 2.
Figure 18:
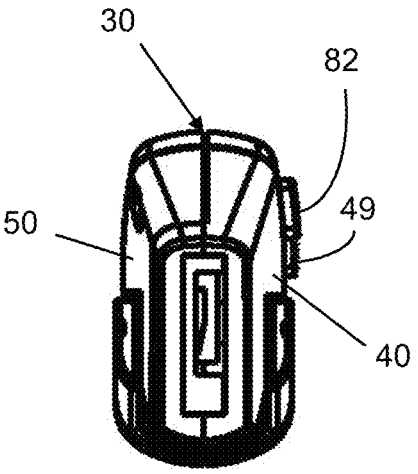
FIG. 18 is a left side view of the knife with the grip position of FIG. 2.
Figure 19:
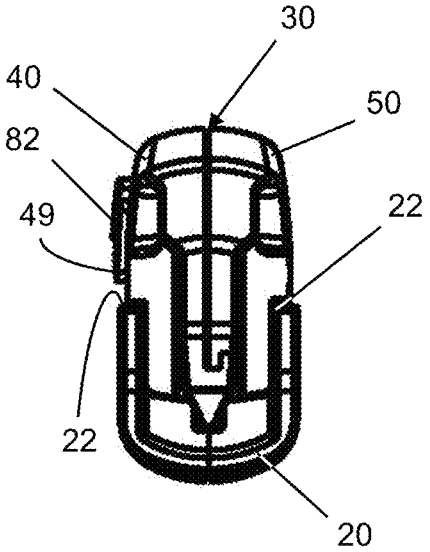
FIG. 19 right side view of the knife with the grip position of FIG. 2.
Figure 14:
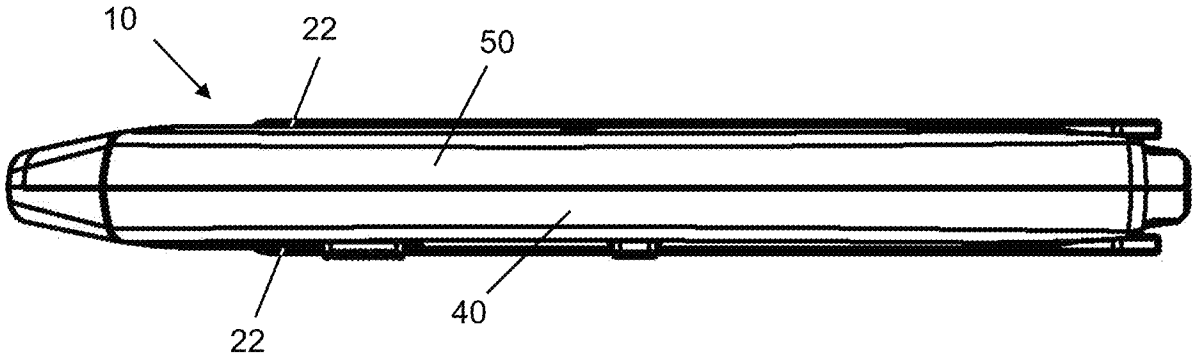
FIG. 14 is a top plan view of the knife with the grip position of FIG. 2.
Figure 15:
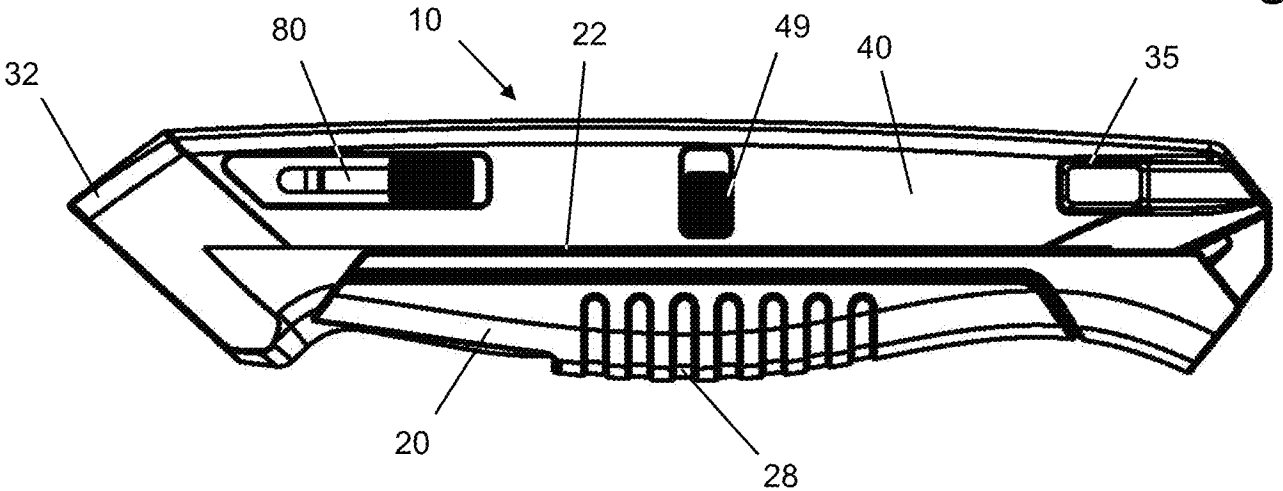
FIG. 15 is a front view of the knife with the grip position of FIG. 2.
Figure 16:
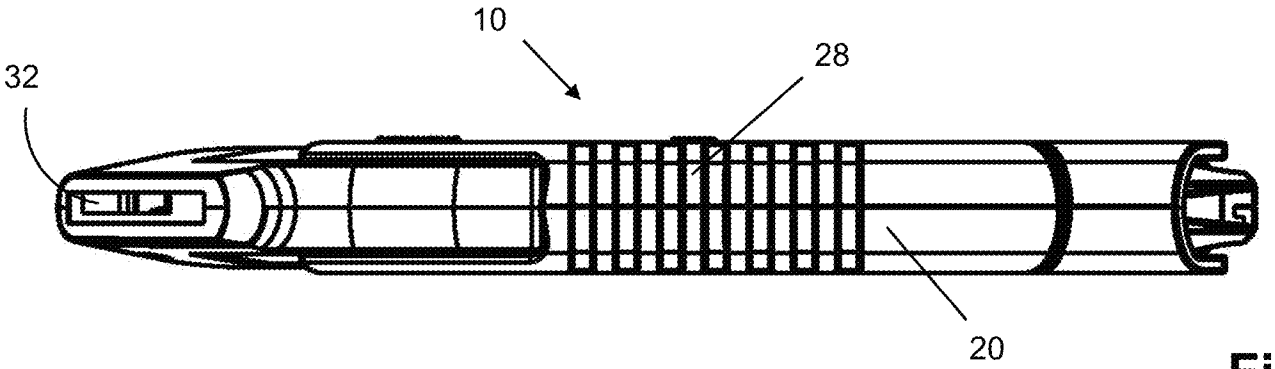
FIG. 16 is a bottom plan view of the knife with the grip position of FIG. 2.
Figure 17:
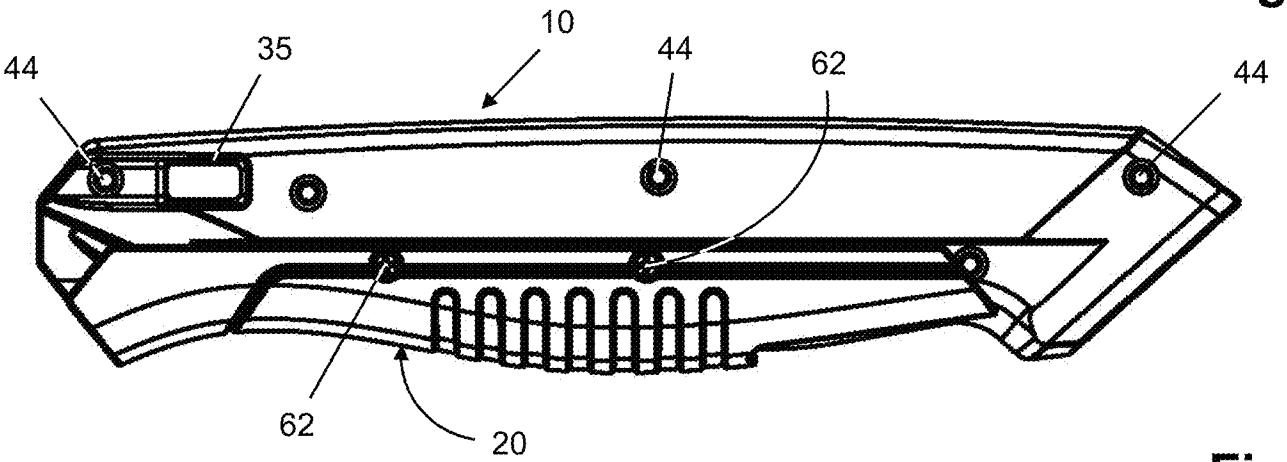
FIG. 17 is a back view of the knife with the grip position of FIG. 2.

With additional reference to FIG. 5, section 40 interiorly mounts three longitudinally spaced bosses 41, 42 and 43. The bosses receive screws 44 connecting through correspondingly located openings of the second section 50 to threadably engage the bosses to secure the sections together.

The housing section 40 interiorly receives and mounts a grip slider 60 which slides along a channel 46 at the interior. The section also has a longitudinal slot 48. The slider mounts a pair of longitudinally spaced bosses 61 and 63. The bosses are receivable in a slot of section 50 and are alignable with corresponding openings in the grip. Screws 62 are threaded through the openings and slot into the bosses to secure the grip 20 to the slider 60.

The slider 60 also includes corresponding longitudinally spaced detents 66 and 68. The detents are alignable with a spring loaded locking lug 67. Upon selective longitudinal displacement of the grip, a detent 66 or 68 will align with the locking lug 67. The lug is spring biased to engage in the detent to provide a stable fixed position of the slide, such as illustrated in FIG. 5. The opposed face of the section 40, which constitutes the frontal face of the knife, has a recess 47 which receives a button 49. When the button 49 is pushed upwardly, the locking lug 67 disengages from the detent and the grip is free to be longitudinally manually displaced relative to the sections 40 and 50. The two detents 66 and 68 essentially define the stable grip positions illustrated respectively in FIGS. 1 and 2.

The section 40 also interiorly mounts a blade slider assembly 70 having a blade slider 72 slidable in a channel formed at the interior of the section. A blade carrier 74 is fixedly mounted to and displaceable with the blade slider 72. The blade carrier 74 mounts the trapezoidal cutting blade 12 having an upper notch 13. The blade carrier 74 includes a forward plate 76 with a transverse projection 77 and a rear pocket 78. The projection 77 is complementary with the notch 13. The blade is partially received at a rear portion in the pocket 78, and the projection 77 locks into the notch to provide a stable blade mount.

Figure 4A:
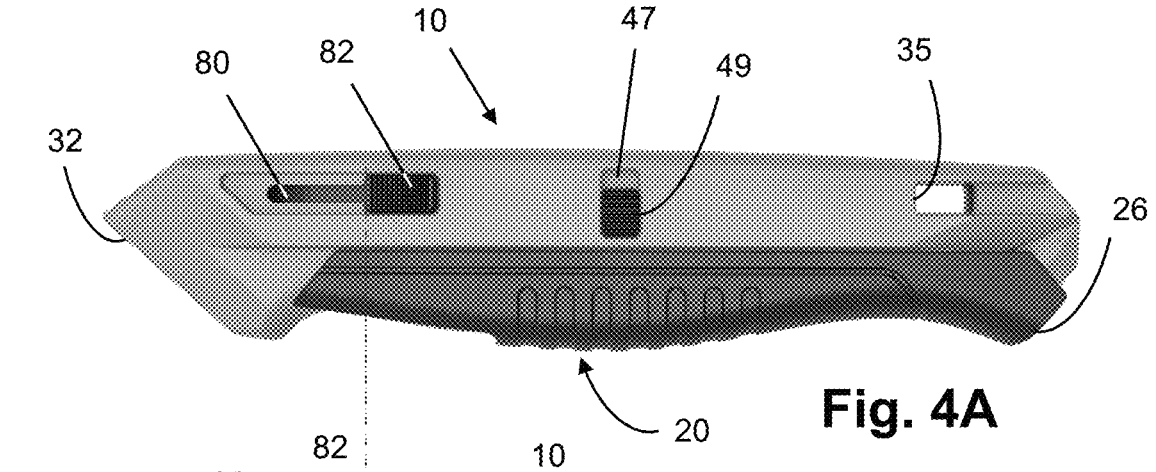
FIGS. 4A-4C are front views of the knife at the grip position of FIG. 1 with a three position blade locking configuration illustrated schematically.
Figure 4B:
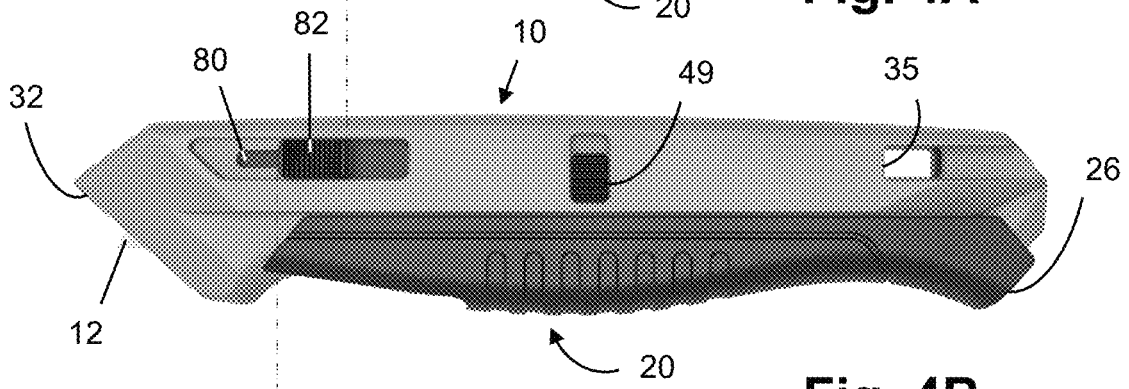
Figure 4C:
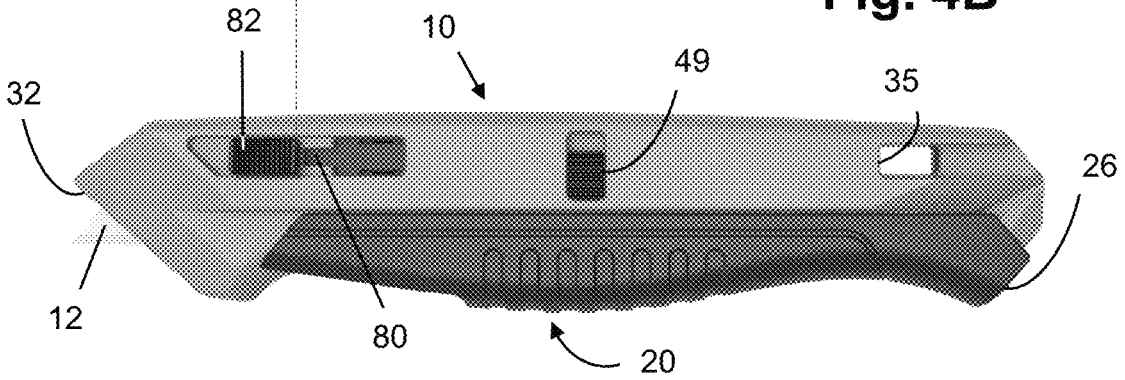

The front side of the section 40 includes a longitudinal slot 80. A position button 82 is received in the slot for longitudinal movement along the slot. The button mechanically fixedly connects with the blade slider 72/blade carrier 74. The blade carrier positions the received blade relative to the frontal blade opening 34. As best illustrated in FIGS. 4A-4C, the positioning button 82 is slidable along the slot 80 to provide various positions for the blade to selectively control its projection through the frontal opening and its retraction into the housing.

The rear of the section 40 mounts the line cutter blade 14 having a central opening 15. A projection 90 extends through the opening 15 to fixedly position the blade. The rear portion of the blade also engages a transverse shelf 92 and an inclined shoulder 94 so that the line blade is in a stable fixed position within the section.

The grip 20 is retained to the blade housing via the fasteners 62 which connect with the grip slide assembly. In addition, the exterior front and back of the housing sections are contoured to be complementary with the upper and opposed interior skirt portions 22 of the grip so that the grip is longitudinally slidable along the housing. When the grip is moved to the forward position of FIG. 1, the forward portion 24 of the grip obstructs access to the frontal opening 34 and the blade 12. The grip release tab 49 is then upwardly displaced and the grip may be manually moved toward the rear until the detent 68 is engaged by the lug 67 to lock the grip at the stable locked position of FIG. 2. In this position, the rear portion 26 of the grip obstructs access to the line cutter blade 14.

It will also be appreciated that the grip has a serrated surface 28 and is generally contoured to provide a grip surface to facilitate usage of the knife. The cutter blade may be fully retracted into the housing at the extreme position illustrated in FIG. 4A, or may be gradually projected to an intermediate position illustrated in FIG. 4B or extended to a more extended position as illustrated in FIG. 4C. In all of the latter three positions, the grip is moved to the rear to allow access to the frontal opening 34 and/or blade 12, but to obstruct access to the line cutter blade 14.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A knife comprising:

a housing having a front defining a frontal blade opening and a rear defining a restricted blade opening;

a grip mounted to said housing and slidably displaceable therealong between a first position obstructing access to a first blade projecting from said frontal blade blade opening and a second position obstructing access to a second blade disposed in said restricted blade opening;

a first mechanism, comprising a spring-loaded member selectively engageable with first and second longitudinally spaced detents, which selectively secures said grip with respect to said housing in a stable engagement at the first position or the second position; and a second mechanism, compsising a blade slider coupled to a blade carrier to which the first blade is fixedly mounted, which slidably projects the first blade for extension through said frontal blade opening at multiple exposed positions.

2. The knife of claim 1 wherein said housing defines a longitudinal slot and said grip is secured through said longitudinal slot to a slide member.

3. The knife of claim 2 wherein said slide member has a pair of longitudinally spaced detents, and a spring loaded lug is receivable in said detent and said housing mounts a laterally displaceable button which is manually moveable to withdraw the lug from a detent and allow said slide member to slide relative to the housing.

4. The knife of claim 1 further comprising a blade fixedly mounted for access through said restricted blade opening.

5. The knife of claim 1 further comprising a blade which is mounted to a longitudinally positionable slider and said housing mounts a longitudinally displaceable button which is moveable to change the position of said slider.

6. The knife of claim 1 wherein said grip further has a plurality of generally transversely extending serrations.

7. The knife of claim 1 wherein said grip has a rubber molded composition.

8. The knife of claim 1 wherein said grip has a quasi-U-shaped section which extends at opposed sides of said housing.

9. The knife of claim 1 wherein said front defines a nose-like configuration.

10. A knife comprising:

a housing having a front defining a frontal blade opening and a rear defining a restricted blade opening and accommodating a first blade and a second blade;

a grip mounted to said housing for slidable displacement therealong between a first position obstructing access to the first blade projecting from said frontal blade opening and a second position obstructing access to the second blade disposed adjacent said restricted blade opening;

a first mechanism for selectively securing said grip in a stable engagement at the first position or the second position; and a second mechanism for slidably projecting the first blade for extension through said frontal blade opening at least one exposed position.

11. The knife of claim 10 wherein said housing defines a longitudinal slot and said grip is connected through said longitudinal slot to a slide member disposed in said housing.

12. The knife of claim 11 wherein said slide member has a pair of longitudinally spaced detents, and a spring loaded lock member receivable in a said detent and said housing mounts a laterally displaceable button which is manually moveable to withdraw the lock member from a detent and allow said slide member to slide relative to the housing.

13. The knife of claim 10 wherein said second blade is fixedly mounted for access through said restricted blade opening.

14. The knife of claim 10 wherein said first blade is mounted to a longitudinally positionable slide and said housing mounts a longitudinally displaceable button which is moveable to change the position of said slide.

15. The knife of claim 10 wherein said grip further has a plurality of generally transversely extending serrations.

16. The knife of claim 10 wherein said grip has a rubber molded composition.

17. The knife of claim 10 wherein said grip has a quasi-U-shaped section which extends at opposed sides of said housing.

18. The knife of claim 10 wherein said housing has a nose-like protuberance.

* * * * *